US009117613B2

(12) United States Patent
Freimuth et al.

(10) Patent No.: US 9,117,613 B2
(45) Date of Patent: Aug. 25, 2015

(54) SHORT CIRCUIT INDICATOR MODULE FOR AN ELECTRICAL SWITCHING DEVICE AND ELECTRICAL SWITCHING DEVICE

(71) Applicants: Michael Freimuth, Hirschau (DE); Jürgen Renner, Sulzbach-Rosenberg (DE)

(72) Inventors: Michael Freimuth, Hirschau (DE); Jürgen Renner, Sulzbach-Rosenberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 157 days.

(21) Appl. No.: 13/721,209

(22) Filed: Dec. 20, 2012

(65) Prior Publication Data

US 2013/0234810 A1 Sep. 12, 2013

(30) Foreign Application Priority Data

Mar. 8, 2012 (DE) ..... 10 2012 203 685

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 77/06*** | (2006.01) |
| ***H01H 71/04*** | (2006.01) |
| *H01H 71/40* | (2006.01) |

(52) U.S. Cl.

CPC ..... *H01H 77/06* (2013.01); *H01H 71/04* (2013.01); *H01H 71/40* (2013.01); *H01H 2071/042* (2013.01); *H01H 2300/052* (2013.01)

(58) Field of Classification Search

CPC ..... H01H 83/04

USPC ..... 335/6, 18

See application file for complete search history.

(56) References Cited

U.S. PATENT DOCUMENTS

| | | | | |
|---|---|---|---|---|
| 4,037,183 | A * | 7/1977 | Gaskill | 335/6 |
| 4,090,156 | A * | 5/1978 | Gryctko | 335/6 |
| 4,831,221 | A * | 5/1989 | Yu et al. | 200/553 |
| 4,939,490 | A * | 7/1990 | Bernier et al. | 335/17 |
| 5,481,235 | A * | 1/1996 | Heise et al. | 335/18 |
| 5,552,755 | A * | 9/1996 | Fello et al. | 335/18 |
| 7,683,745 | B2 * | 3/2010 | Gouhl et al. | 335/13 |
| 8,049,122 | B2 * | 11/2011 | Watford | 200/302.2 |

FOREIGN PATENT DOCUMENTS

| | | | |
|---|---|---|---|
| DE | 3837461 | A1 | 5/1990 |
| DE | 102004055376 | A1 | 8/2008 |
| DE | 102010022598 | A1 | 12/2011 |

* cited by examiner

*Primary Examiner* — Alexander Talpalatski

(74) *Attorney, Agent, or Firm* — Harness, Dickey & Pierce, P.L.C.

(57) ABSTRACT

A short circuit indicator module is disclosed for an electrical switching device, in particular for a circuit breaker. The electrical switching device is configured to interrupt a current flow in the event of a short circuit and/or an overload in a subordinate power circuit. The module includes a housing, a display facility for indicating tripping of the electrical switching device in the event of a short circuit and a movable unlatching element, it being possible for the display facility to be activated by a movement of the unlatching element and the unlatching element being configured to form a functional connection between the short circuit indicator module and the electrical switching device. The module is configured to test the activatability of the display facility of the short circuit indicator module and/or to test the functional connection between the short circuit indicator module and the electrical switching device.

16 Claims, 5 Drawing Sheets

SHORT CIRCUIT INDICATOR MODULE FOR AN ELECTRICAL SWITCHING DEVICE AND ELECTRICAL SWITCHING DEVICE

PRIORITY STATEMENT

The present application hereby claims priority under 35 U.S.C. §119 to German patent application number DE 10 2012 203 685.7 filed Mar. 8, 2012, the entire contents of which are hereby incorporated herein by reference.

FIELD

At least one embodiment of the invention generally relates to an electrical switching device.

BACKGROUND

Electrical switching devices, for example circuit breakers or molded case circuit breakers, in particular have the task of decoupling one or a number of consumers in the event of a fault in a voltage supply network. Conventional types of fault here are the occurrence of a short circuit or the occurrence of an overcurrent. A thermomagnetic overcurrent detection unit is often used in the electrical switching devices, being embodied to trip in the event of a short circuit and in the event of an overcurrent, thereby ensuring decoupling from the voltage supply network.

When such a thermomagnetic overcurrent detection unit is used, it is however not easy for the user to determine the reason for the fault responsible for tripping the electrical switching device. The user is not given any information about whether a short circuit or an overcurrent has caused the isolation of the power circuit. To determine the reason for the fault, it is therefore necessary to examine the subordinate power circuit for possible causes.

If no obvious short circuit is found, the user will in particular assume an overcurrent to be the reason for the thermomagnetic overcurrent detection unit of the electrical switching device tripping. However if this judgment is wrong and a short circuit that is not obvious was the reason for the electrical switching device tripping, reactivation of the electrical switching device can have fatal consequences for the user. The short circuit still present in the subordinate power circuit means that the thermomagnetic overcurrent detection unit will trip again immediately. Disadvantageous consequences for the user, even injury, can result.

An insertable indicator switch module for an electrical switching device configured as a switch, in particular a low voltage circuit breaker, is known from DE 10 2010 022 596 A1, indicating the reason for tripping when the electrical switching device trips in the event of a short circuit. Since this indicator module, which can in particular be retrofitted, is only activated when a fault is due to a short circuit, said reason is also indicated to the user in the event of a short circuit. The user of the electrical switching device is therefore informed that there is a short circuit in the subordinate power circuit.

The user trusts that a short circuit in the subordinate power circuit can reliably be indicated as the reason for the electrical switching device tripping by such an indicator switch module. In the case of an electrical switching device which has been retrofitted with such an indicator module in particular, the user cannot however be certain that the indicator module and the electrical switching device interact in the intended manner.

SUMMARY

An embodiment of the present invention is directed to reducing or even eliminating at least one of the disadvantages of known indicator modules for electrical switching devices as described above at least to some degree. In particular, an embodiment is directed to a short circuit indicator module or an electrical switching device having a short circuit indicator module, in which the interaction of the short circuit indicator module and the electrical switching device can be verified. In particular a short circuit indicator module or an electrical switching device having a short circuit indicator module is to be created, which can offer the user a high degree of certainty in respect of the functioning interaction of the short circuit indicator module and the electrical switching device.

Further features and details of the invention will emerge from the subclaims, the description and the drawings. Features and details described in the context of the inventive short circuit indicator module of course also apply here in the context of the inventive electrical switching device and vice versa, so that reference is or can always be made reciprocally to the individual aspects of the invention in respect of the disclosure.

A first aspect of an embodiment is directed to a short circuit indicator module for an electrical switching device, in particular for a circuit breaker, the electrical switching device being configured to interrupt a current flow in the event of a short circuit and/or an overload in a subordinate power circuit and the device including a housing, a display facility for indicating tripping of the electrical switching device in the event of a short circuit and a movable unlatching element, it being possible for the display facility to be activated by a movement of the unlatching element and the unlatching element being configured to form a functional connection between the short circuit indicator module and the electrical switching device. In particular, the inventive short circuit indicator module of at least one embodiment is characterized in that the short circuit indicator module is configured to test the activatability of the display facility of the short circuit indicator module and/or to test the functional connection between the short circuit indicator module and the electrical switching device.

BRIEF DESCRIPTION OF THE DRAWINGS

The present invention is described in more detail below with reference to the accompanying schematic drawings, in which.

Elements of identical function and mode of operation are shown with the same reference characters in FIGS. 1 to 6.

DETAILED DESCRIPTION OF THE EXAMPLE EMBODIMENTS

Figure 1:
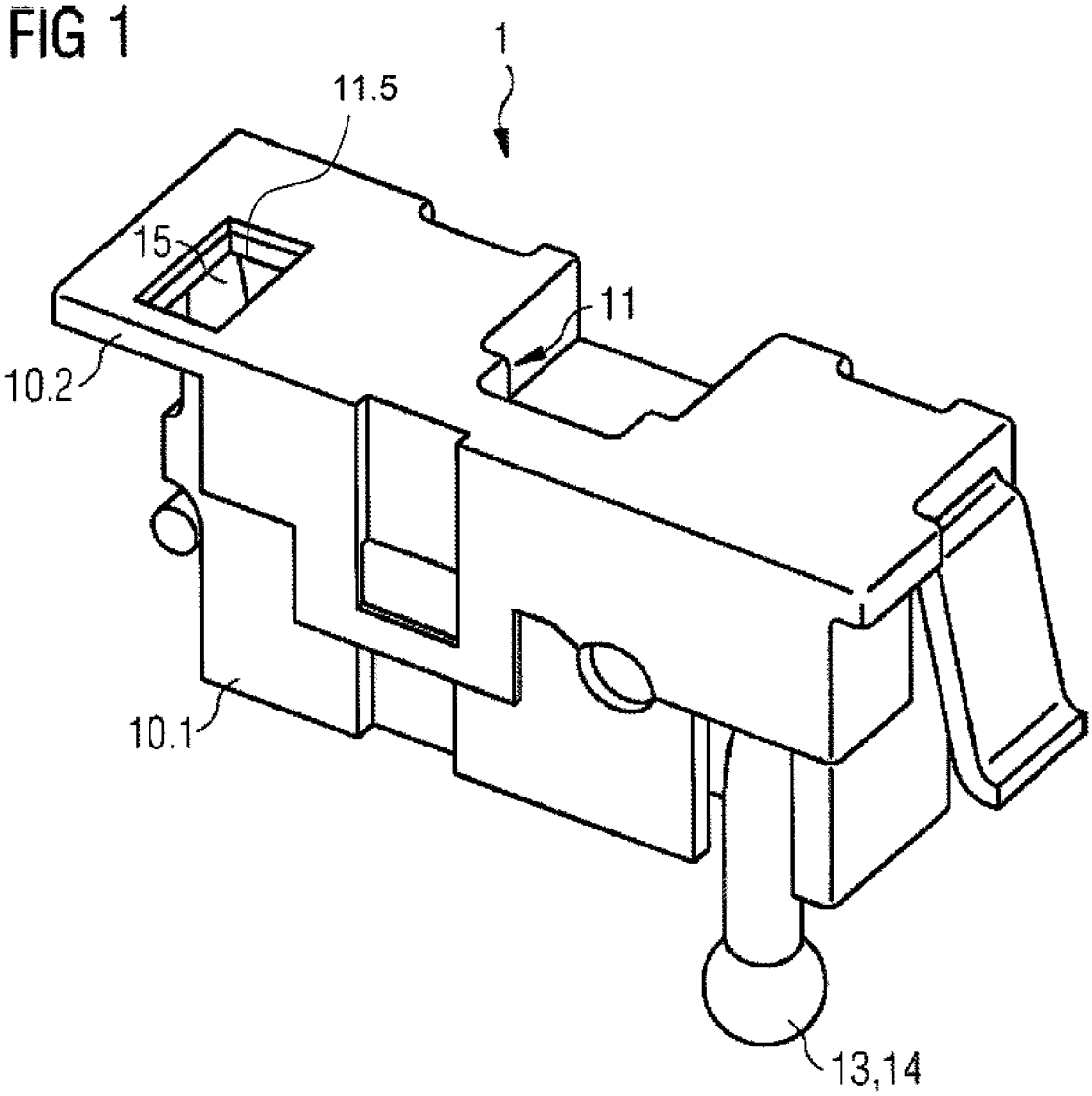
FIG. 1 shows a first embodiment of an inventive short circuit indicator module.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A first aspect of an embodiment is directed to a short circuit indicator module for an electrical switching device, in particular for a circuit breaker, the electrical switching device being configured to interrupt a current flow in the event of a short circuit and/or an overload in a subordinate power circuit and the device including a housing, a display facility for indicating tripping of the electrical switching device in the event of a short circuit and a movable unlatching element, it being possible for the display facility to be activated by a movement of the unlatching element and the unlatching element being configured to form a functional connection between the short circuit indicator module and the electrical switching device. In particular, the inventive short circuit indicator module of at least one embodiment is characterized in that the short circuit indicator module is configured to test the activatability of the display facility of the short circuit indicator module and/or to test the functional connection between the short circuit indicator module and the electrical switching device.

The short circuit indicator module is activated when the electrical switching device is tripped in the event of a short circuit. It therefore only indicates instances of the electrical switching device being tripped, for which a short circuit is present as the cause. It is therefore possible for the user of an electrical switching device with such a short circuit indicator module to distinguish tripping of the electrical switching device due to a short circuit from tripping due to an overload. The display facility here can be disposed directly in the short circuit indicator module.

Alternatively of course an external display facility, which can be structurally separate from the short circuit indicator module, can be activated. The short circuit indicator module can in particular also be embodied in such a manner that the electrical switching device can be retrofitted with the short circuit indicator module. A user of the electrical switching device therefore does not have to decide in favor of a short circuit indicator module when the electrical installation as a whole is designed but can decide to incorporate a short circuit indicator module later when the need for such a short circuit indicator module becomes evident. Different, adapted models of short circuit indicator modules are of course also possible for different electrical switching devices, in particular electrical switching devices for different electrical outputs.

Major components of the short circuit indicator module are both the display facility of the short circuit indicator module and the part of the short circuit indicator module, which establishes the functional connection between the short circuit indicator module and the electrical switching device. Because the short circuit indicator module is configured to test the activatability of the display facility of the short circuit indicator module, the user can ensure by way of a test that the display facility also functions. Testing can be performed for example by way of a test facility, for example a test button, on the short circuit indicator module, the test button being able to act in the interior of the short circuit indicator module, in particular directly on the display facility. Other test options, for example by introducing a test tool and/or by electrical activation are of course also conceivable.

By testing the functional connection between the short circuit indicator module and the electrical switching device the user of an inventive short circuit indicator module can be certain that said functional connection on the one hand is present and on the other hand also functions. The test here can in particular go so far as initiating the tripping of the electrical switching device when testing the functional connection between the short circuit indicator module and the electrical switching device. Different embodiments of the test function, as already described for the test for the activatability of the display facility, are of course also conceivable for this test. It is particular preferable for an inventive short circuit indicator module if it is possible to test both the activatability of the display facility of the short circuit indicator module and the functional connection between the short circuit indicator module and the electrical switching device. The possibility of testing both properties of an inventive short circuit indicator module provides the user with a particularly high level of operating safety.

Provision can also be made with an inventive short circuit indicator module for the unlatching element to be configured so that it can be actuated, in particular moved, to test the short circuit indicator module. The unlatching element is a central component of the inventive short circuit indicator module. The movable unlatching element in particular activates the display facility and configures the functional connection between the short circuit indicator module and the electrical switching device. By actuating, in particular moving, the unlatching element when the inventive short circuit indicator module is being tested, it is possible to test both the subordinate display facility and the functional connection between the short circuit indicator module and the electrical switching device, in particular at the same time. This is a particularly simple and in particular user-friendly way of testing the two most important functions of the inventive short circuit indicator module at the same time.

Provision can also be made with an inventive short circuit indicator module for the housing to have a first opening, which is disposed in such a manner that a test tool that can be introduced through the first opening can be made to engage operationally with the unlatching element to test the short circuit indicator module. The test tool used here can be for example a screwdriver or a suitable piece of wire. Specially manufactured test tools are of course also conceivable. Specially manufactured test tools have the advantage in particular that they are advantageously only accessible for the user of the electrical switching device or short circuit indicator module, thereby preventing unauthorized persons testing the inventive short circuit indicator module. The test tool is introduced through the first opening in the housing into the short circuit indicator module.

In the interior of the short circuit indicator module the test tool engages operationally with the unlatching element, in other words the unlatching element can be actuated by the test tool. The unlatching element can have in particular specific test geometries, which are configured to interact with the test tool and therefore together with the test tool to form the operational engagement of the test tool with the unlatching element.

As the unlatching element is a central component of the inventive short circuit indicator module, which is configured both to activate the display facility and to form the functional connection between the short circuit indicator module and the electrical switching device, the operational engagement of the test tool with the unlatching element allows the entire chain of effect within the short circuit indicator module to be tested, from the functional connection to the electrical switching device to the indication of a short circuit by the display facility. By using a test tool it can further be ensured that the short circuit indicator module cannot be tested accidentally, as testing of the short circuit indicator module can result in tripping of the electrical switching device and therefore to isolation of the switching contacts of the electrical switching device. In particular the use of a test tool therefore presents a particularly reliable and for the user a particularly simple way of testing a short circuit indicator module.

Provision can also be made with at least one embodiment of the inventive short circuit indicator module for the unlatching element to have an unlatching lever, which is configured to engage in a recess in the electrical switching device to form the functional connection between the short circuit indicator module and the electrical switching device. The engagement of the unlatching lever in a recess in the electrical switching device provides a particularly simple, form-fit connection between the short circuit indicator module and the electrical switching device. This form-fit connection in particular forms the functional connection between the inventive short circuit indicator module and the electrical switching device, in which at least one embodiment of the inventive short circuit indicator module is incorporated.

The engagement of the unlatching lever here can be embodied such that the unlatching element, which comprises the unlatching lever, can be moved in a linear or rotatory manner in at least two directions. This in particular allows both activation and deactivation of the display facility that is subordinate to the unlatching element. It is particularly preferable for provision to be made here of course for the unlatching lever to be matched to the type of electrical switching device, in particular to the type of recess in the electrical switching device. This allows many different models of electrical switching devices to be equipped with at least one embodiment of an inventive short circuit indicator module. The areas of use of at least one embodiment of an inventive short circuit indicator module can thus be extended.

Provision can also be made with at least one embodiment of an inventive short circuit indicator module for the unlatching element to be configured to block the electrical switching device by way of the functional connection. A short circuit indicated by the short circuit indicator module after the electrical switching device has tripped can still be present in particular in the subordinate power circuit.

To safeguard the user, the short circuit has to be eliminated before the electrical switching device is reactivated. Because the electrical switching device is blocked by the unlatching element by way of the functional connection in the event of a short circuit, the user cannot simply reactivate the electrical switching device. The user must actively cancel the blocking of the short circuit indicator module. This should in particular only happen when the user has eliminated the short circuit in the subordinate power circuit.

The user can be reminded of this condition once again by the blocking of the electrical switching device by the unlatching element of at least one embodiment of the inventive short circuit indicator module, as said user must actively terminate the blocking of the electrical switching device by at least one embodiment of the inventive short circuit indicator module. This increases safety further, as the block once again indicates to the user that he/she must eliminate the short circuit in the subordinate power circuit before reactivating the electrical switching device.

In one preferred development of at least one embodiment of an inventive short circuit indicator module, provision can be made for the short circuit indicator module to be embodied so that it can be reset manually and/or automatically to cancel the blocking of the electrical switching device. For manual cancelation of the block, the user must actively cancel the block, in particular at the short circuit indicator module, as described above. This increases user safety further, as said user is once again informed that the short circuit is the reason for the electrical switching device tripping. Automatic resetting of the short circuit indicator module to cancel the block in particular allows remote maintenance of the electrical switching device. It is then for example possible also to equip such electrical switching devices with short circuit indicator modules that are not accessible during operation and to reset them.

Provision can also be made with at least one embodiment of the inventive short circuit indicator module for the display facility to be configured as a single piece with the unlatching element. In this embodiment of an inventive short circuit indicator module activation of the display facility by the unlatching element is embodied in a particularly simple manner, as it is configured as a single piece with the unlatching element. For the single-piece embodiment of the display facility with the unlatching element the display facility, which can be embodied as an angle and/or flag, can in particular be bonded or for example welded to the unlatching element.

In one development of at least one embodiment of an inventive short circuit indicator module provision can also be made for the display facility to be configured monolithically with the unlatching element. In the context of at least one embodiment of the invention, monolithically means that the display facility and the unlatching element have been produced together in the same production step. No additional assembly is therefore required to dispose the display facility on the unlatching element. This saves time and therefore also costs in particular when producing an inventive short circuit indicator module.

Provision can also be made with at least one embodiment of the inventive short circuit indicator module for the housing of the short circuit indicator module to have a second opening for the display facility to indicate tripping of the electrical switching device. It is in particular conceivable here for the display facility to be displaced relative to the second opening in the housing during activation of the display facility by the unlatching element of the short circuit indicator module in such a manner that the part of the display facility visible through the second opening changes. This can be in particular a first exposure of the display facility through the second opening or a change of color of the part of the display facility visible through the second opening.

In particular, the part of the display facility visible through the second opening in the housing of the short circuit indicator module when the electrical switching device is activated can for example be colored green, while in the event of a tripped state of the electrical switching device due to a short circuit it can be colored red. In a further conceivable embodiment at least one part of the display facility can be moved through the second opening, in the event of a tripped state of the electrical switching device due to a short circuit to outside the short circuit indicator module. In particular of course the part of the display facility moved outside can also be marked with a color, in particular red. In particular the presence of a second opening in the housing of the short circuit indicator module for the display facility to indicate tripping of the electrical switching device is a particularly simple way of indicating a short circuit. No additional components, such as a subordinate mechanical system and/or electrical circuits, are required to indicate a short circuit.

According to a second aspect of at least one embodiment of the invention, an electrical switching device is disclosed for interrupting a current flow in the event of a short circuit and/or an overload in a subordinate power circuit, having at least two switching contacts, by way of which the current can flow and which can be isolated in the event of a short circuit and/or an overload, a tripping device, comprising a trip element and an electromagnet, at least some of the current being able to flow through the electromagnet and its magnetic forces displacing the trip element to a trip position in the event of a short circuit, in which trip position the trip element actuates a switching mechanism of the electrical switching device to isolate the switching contacts and a short circuit indicator module. The electrical switching device here is embodied in particular in such a manner that the short circuit indicator module is embodied according to an embodiment of the first aspect of the invention.

All the advantages that have been described in conjunction with a short circuit indicator module according to at least one embodiment of the first aspect of the invention therefore also naturally result for an electrical switching device equipped with a short circuit indicator module embodied according to at least one embodiment of the first aspect of the invention. In particular the short circuit indicator module for the electrical switching device can be embodied in such a manner that it can be retrofitted, in other words already existing electrical switching devices can be equipped at a later stage with an inventive short circuit indicator module according to at least one embodiment of the first aspect of the invention. In particular the possibility of testing the activatability of the display facility of the short circuit indicator module and/or testing the functional connection between the short circuit indicator module and the electrical switching device means that the user of such a switching device can be certain of the functioning of the short circuit indicator module.

Provision can also be made with an embodiment of an inventive electrical switching device for the trip element to have a recess, in which the unlatching element of the short circuit indicator module engages to establish a functional connection. In particular the recess can be embodied in a standardized manner. This means that different electrical switching devices can be equipped with a standardized short circuit indicator module. This reduces costs in particular, as identically structured short circuit indicator modules can be used for different electrical switching devices. Provision can alternatively be made for the recess in the trip element of the electrical switching device to be embodied differently for different electrical switching devices. Different embodiments of the unlatching elements of the short circuit indicator modules, which are to be connected to the respective electrical switching, are then also required. It can then be ensured that different electrical switching devices, which are designed in particular for different current and/or power requirements, are also equipped with different short circuit indicator modules, which are also designed for the current and/or power requirements. By providing different recesses, it is therefore possible to ensure that matched electrical switching devices and short circuit indicator modules are used. This ensures the effective functioning of both modules, the short circuit indicator module and the electrical switching device.

Provision can also be made with electrical switching devices for the electrical switching device to be a circuit breaker, in particular a molded case circuit breaker. A circuit breaker here is in particular an electromagnetic automatic switch. It is often also used as a power protection switch, in other words an overcurrent protection facility in an electrical installation. A molded case circuit breaker in particular is often used for low voltages. Use as a motor protection switch is also possible. An embodiment of the inventive electrical switching device as a circuit breaker, in particular as a molded case circuit breaker, therefore allows the electrical switching device to be used for a plurality of applications.

FIG. 1 shows an inventive short circuit indicator module 1. The inventive short circuit indicator module 1 in particular has a housing 10, which in the embodiment shown is divided into a housing lower part 10.1 and a housing upper part 10.2. The two housing parts 10.1, 10.2 are held together in the embodiment shown by way of a snap-fit connection.

Projecting from the housing lower part 10.1 of the short circuit indicator module 1 is an unlatching lever 14, which is embodied as part of the unlatching element 13. The unlatching lever 14 is configured to engage in a recess 112 in a trip element 111 of a thermomagnetic tripping device 110 of an electrical switching device 100 (not shown), to establish a functional connection between the short circuit indicator module 1 and the electrical switching device 100. During movement of the trip element 111 of the electrical switching device 100 the unlatching lever 14 and therefore the unlatching element 13 of the short circuit indicator module 1 are also moved by way of the functional connection.

In the illustrated embodiment of the inventive short circuit indicator module 1 in particular this activates a trip slide 15. This trip slide 15 can in particular activate a subordinate display facility 12 (not shown). Visible in the housing upper part 10.2 is a first opening 11.

A test tool can be introduced through this first opening 11 into the interior of the short circuit indicator module 1 and be connected operationally to the unlatching element 13. This allows the unlatching element 13 in particular to be moved. This also causes the unlatching lever 14 to move, thereby in particular also tripping the electrical switching device 100 by way of the functional connection between the short circuit indicator module 1 and the electrical switching device 100. This allows the functional connection between the short circuit indicator module 1 and the electrical switching device 100 to be tested. When there is an operational connection between the test tool and the unlatching element 13, the trip slide 15 and its subordinate display facility 12 can also be activated.

By introducing a test tool into the first opening 11 in the housing upper part 10.2 when testing the short circuit indicator module 1, it is also possible to test the activatability of the display facility 12. It can thus be ensured that the functional connection between the short circuit indicator module 1 and the electrical switching device 100 functions and also that the display facility 12 is able to indicate a short circuit when the electrical switching device 100 is tripped. It can thus be ensured that the short circuit indicator module 1 as a whole is functioning.

Figure 2:
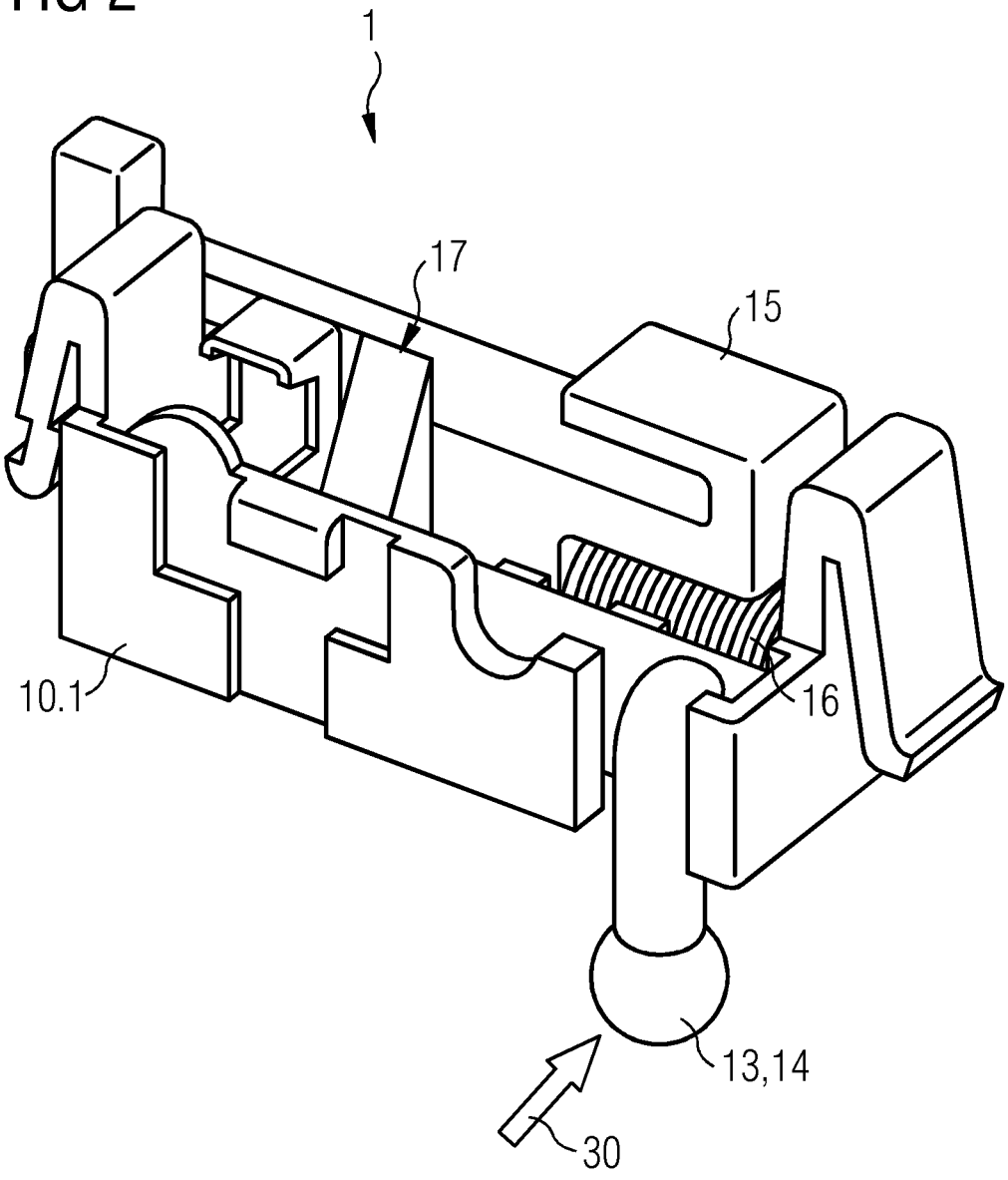
FIG. 2 shows the possible embodiment of an inventive short circuit indicator module illustrated in FIG. 1 with the housing upper part removed.

FIG. 2 shows an embodiment of an inventive short circuit indicator module 1, as already shown and described in FIG. 1, with the housing upper part 10.2 removed. Visible in the interior of the short circuit indicator module 1 in addition to the unlatching element 13 and the trip slide 15 is the trip spring 16. When the unlatching lever 14 of the unlatching element 13 moves in an actuation direction 30 (shown by an arrow), the trip slide 15 is released by the unlatching element 13 and the spring energy stored in the trip spring 16 moves the trip slide 15. This allows a subordinate display facility 12 to be activated. The actuation direction 30 corresponds here to the movement of the trip element 111 of the electrical switching device 100 when there is a short circuit in the subordinate power circuit.

A test geometry 17 is also visible on the unlatching element 13. The test geometry can be accessed by a test tool through the first opening 11 in the housing upper part 10.2 (see FIG. 1). Introducing the test tool into the first opening 11 causes the test tool to be connected operationally to the test geometry 17, thereby moving the unlatching element 13. This again releases the trip slide 15 so that it is then displaced by the trip spring 16. This tests the activatability of the subordinate display facility 12.

Also when the unlatching element 13 moves, the operational engagement of a test tool with the test geometry 17 also causes the unlatching lever 14 to move. When the functional connection between the short circuit indicator module 1 and the electrical switching device 100 functions, the electrical switching device 100 in particular can also be tripped. This also allows the functional connection between the short circuit indicator module 1 and the electrical switching device 100 to be tested.

Figure 3:
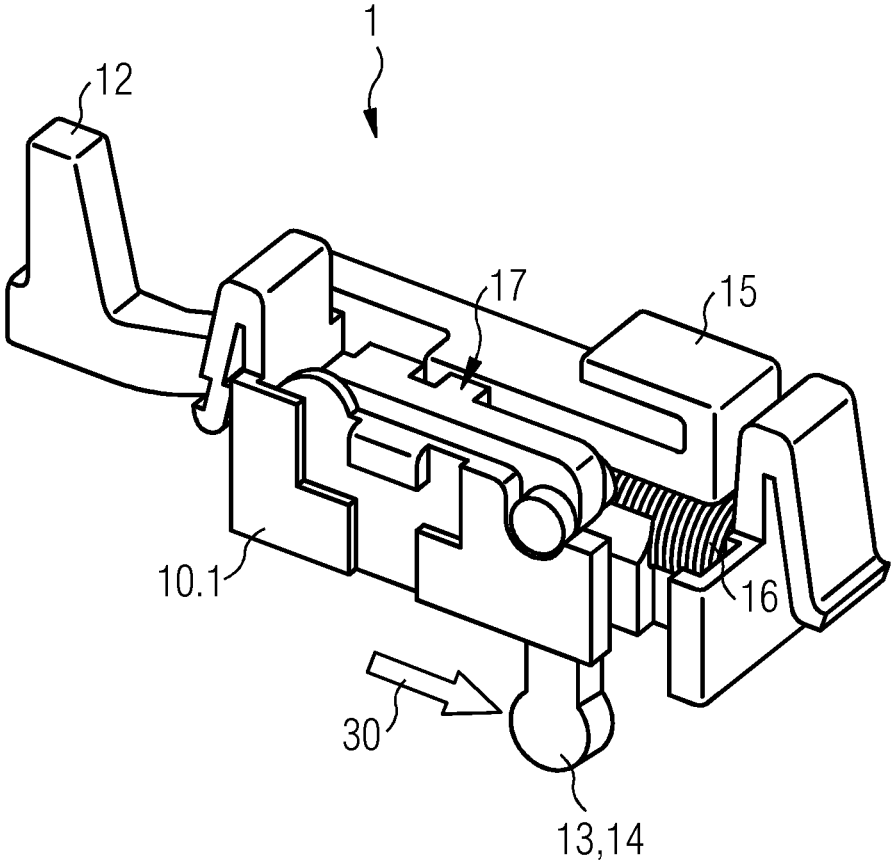
FIG. 3 shows a further possible embodiment of an inventive short circuit indicator module, also with the housing upper part removed.

FIG. 3 shows a further embodiment of an inventive short circuit indicator module 1, in which the housing upper part 10.2 is also removed. In this illustrated embodiment of the inventive short circuit indicator module 1 the display facility 12 is embodied as an injection-molded angle on the trip slide 15. When the electrical switching device 100 is tripped, the functional connection between the short circuit indicator module 1 and the electrical switching device 100 moves the unlatching element 13, or in particular the unlatching lever 14, in the actuation direction 30. This releases the trip slide 15, causing it to be displaced by the energy stored in the trip spring 16.

Figure 5:
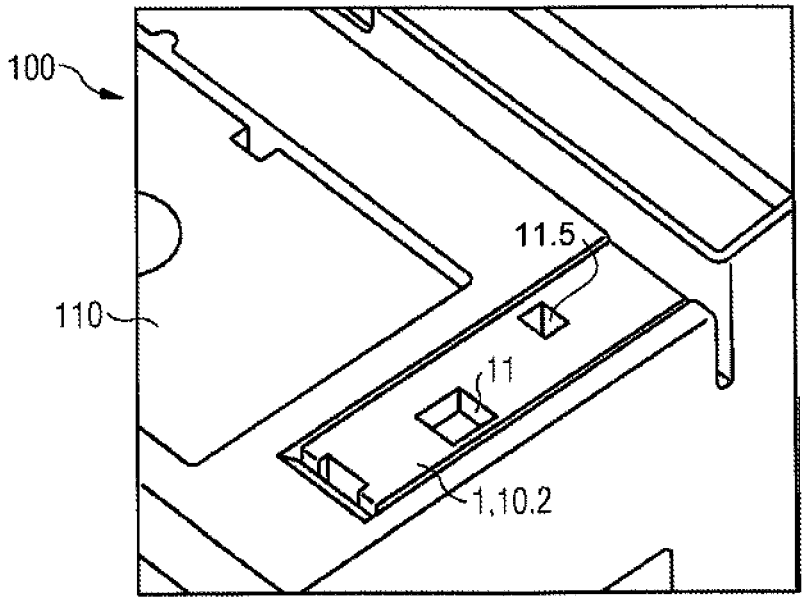
FIG. 5 shows a partial view of an electrical switching device with an incorporated inventive short circuit indicator module and FIG. 6 shows a sectional view of a segment of an inventive electrical switching device with an inventive short circuit indicator module.

In particular in this embodiment of the inventive short circuit indicator module 1 the housing upper part 10.2 (not shown) has a second opening 11.5, as shown in FIGS. 1 and 5, through which the displaced display facility 12 becomes visible when the electrical switching device is tripped in the event of a short circuit. Tripping of the switching device 100 is thus indicated to the user of an electrical switching device 100 equipped with an inventive short circuit indicator module 1 in the event of a short circuit. The exposure of the display facility 12 in the second opening of the housing upper part 10.2 is a particularly simple way of indicating a short circuit in the short circuit indicator module 1.

Figure 4:
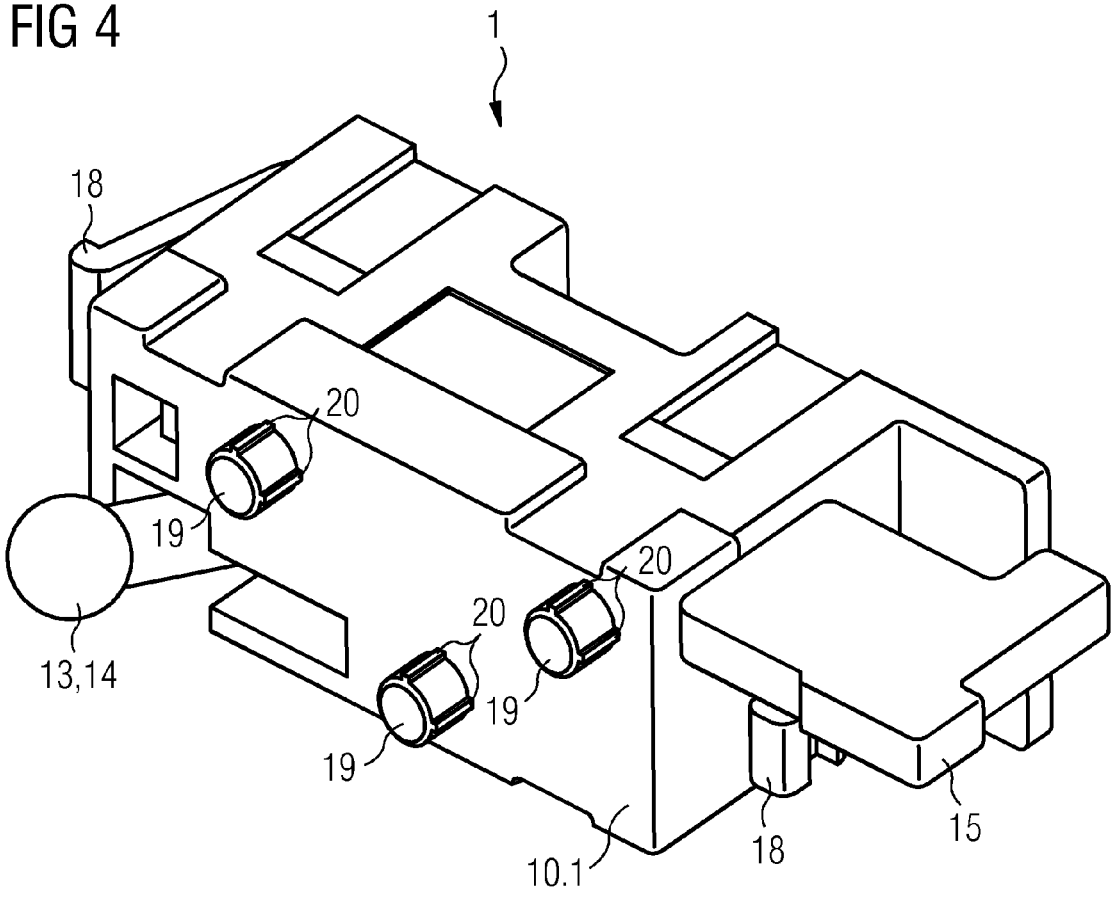
FIG. 4 shows a perspective view of a further embodiment of an inventive short circuit indicator module.

FIG. 4 shows a perspective view of a further embodiment of an inventive short circuit indicator module 1. It can be seen in this diagram in particular how a short circuit indicator module 1 can be fastened on or in an electrical switching device 100. Snap hooks 18 are provided here in particular, to snap into corresponding recesses, in particular in a housing of an electrical switching device 100. This allows the short circuit indicator module 1 to be held and positioned securely in or on the electrical switching device 100.

The provision of centering pins 19 allows the position of the short circuit indicator module 1 at its installation site in or on the electrical switching device 100 to be defined even more precisely. The centering pins 19 can be prevented from slipping in the corresponding recesses on or in the electrical switching device 100 by fins 20. It can thus be ensured that the short circuit indicator module 1 can be positioned in a precise and defined manner on or in the electrical switching device 100. This allows the unlatching lever 14 of the unlatching element 13 to engage in a reliable and defined manner in a recess 112 in an electrical switching device 100 (not shown).

The functional connection between the short circuit indicator module 1 and the electrical switching device 100 can thus be produced in a defined and reproducible manner. The trip slide 15 of the short circuit indicator module 1 is therefore also present in a precise and clearly defined position. Subordinate components, such as in particular a display facility 12 (not shown), can thus also be activated in a reliable and precise manner by the short circuit indicator module 1.

FIG. 5 shows a segment of an electrical switching device 100. It can be seen clearly here that a short circuit indicator module 1 is disposed in direct proximity to a thermomagnetic tripping device 110 of the electrical switching device 100. The short circuit indicator module 1, in particular the visible part of the housing upper part 10.2 of the short circuit indicator module 1, has a first opening 11. A test tool in particular can be introduced into this first opening 11, in order to connect operationally to the unlatching element 13, to test the activatability of the display facility 12 of the short circuit indicator module 1 and/or the functional connection between the short circuit indicator module 1 and the electrical switching device 100.

Figure 6:
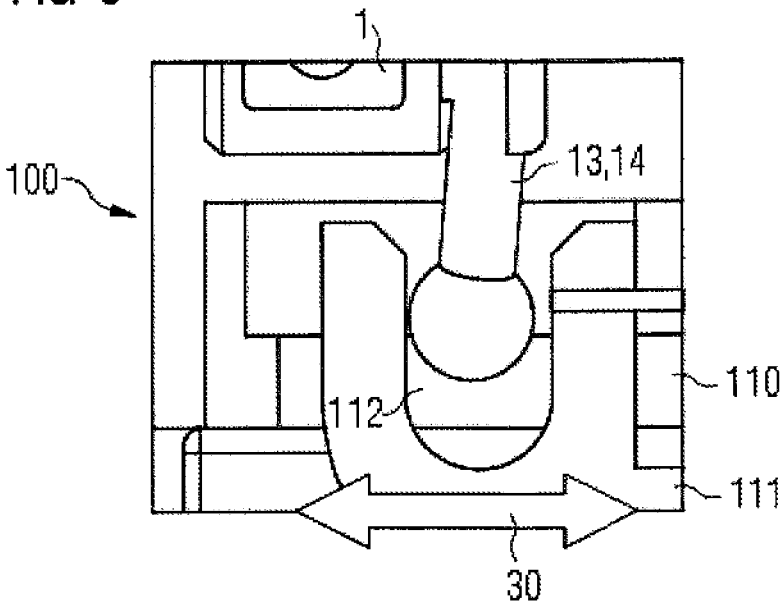

FIG. 6 shows a sectional view of a segment of an electrical switching device 100, which has an inventive short circuit indicator module 1. Part of a thermomagnetic tripping device 110 is shown in particular. The thermomagnetic tripping device 110 in particular has a trip element 111, on which a recess 112 is disposed. The unlatching lever 14 of the unlatching element 13 of the short circuit indicator module 1 engages in this recess 112.

When the thermomagnetic tripping device 110 of the electrical switching device 100 trips, the trip element 111 moves in movement direction 30. The engagement of the unlatching lever 14 in the recess 112 provides a functional connection between the short circuit indicator module 1 and the electrical switching device 100. This form-fit connection means that when the trip element 111 moves in actuation direction 30, the unlatching lever 14 of the unlatching element 13 also moves. This activates the display facility 12 (not shown) in the short circuit indicator module 1. The tripping of the electrical switching device 100 in the event of a short circuit is thus indicated to the user of an electrical switching device 100 with a short circuit indicator module 1.

The short circuit indicator module 1 can also in particular be embodied so that after tripping the unlatching element 13 blocks the movement of the trip element 111 by way of the functional connection after a short circuit. Reactivation of the electrical switching device 100 is thus only possible after the user has actively reset the short circuit indicator module 1. This increases the safety of the user of such an electrical switching device 100 further, as said user has to actively reset the short circuit indicator module 1 before reactivating the electrical switching device 100 and is thus reminded once again of the short circuit in the subordinate power circuit.

The above explanation of the embodiments only describes the present invention in the context of examples. Individual features of the embodiments can of course be combined freely with one another, in so far as this is technically expedient, without departing from the scope of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Short circuit indicator module
10 Housing
10.1 Housing lower part
10.2 Housing upper part
11 First opening
12 Display facility
13 Unlatching element
14 Unlatching lever

15 Trip slide
16 Trip spring
17 Test geometry
18 Snap hooks
19 Centering pins
20 Fins
30 Actuation direction
100 Electrical switching device
110 Thermomagnetic tripping device
111 Trip element
112 Recess

What is claimed is:

1. A short circuit indicator module for an electrical switching device, the electrical switching device being configured to interrupt a current flow in an event of at least one of a short circuit and an overload in a subordinate power circuit, the short circuit indicator module comprising:

a housing including a first opening and a second opening at different locations on the housing;

a display facility, configured to indicate tripping of the electrical switching device in the event of a short circuit by being viewable through the second opening; and a movable unlatching element, the display facility being configured to be activated by a movement of the unlatching element and the unlatching element being configured to form a functional connection between the short circuit indicator module and the electrical switching device, the short circuit indicator module being configured to test the activatability of the display facility of the short circuit indicator module and to test the functional connection between the short circuit indicator module and the electrical switching device, wherein the first opening is disposed such that a test tool that is introducible through the first opening is engagable with the unlatching element to test the activatability of the display facility and to test the functional connection.

2. The short circuit indicator module of claim 1, wherein the unlatching element is configured to be actuatable to test the activatability of the display facility.

3. The short circuit indicator module of claim 1, wherein the unlatching element includes an unlatching lever, configured to engage in a recess in the electrical switching device to form the functional connection between the short circuit indicator module and the electrical switching device.

4. The short circuit indicator module of claim 1, wherein the unlatching element is configured to block the electrical switching device by way of the functional connection.

5. The short circuit indicator module of claim 4, wherein the short circuit indicator module is embodied to be at least one of manually and automatically resettable to cancel the blocking of the electrical switching device.

6. The short circuit indicator module of claim 1, wherein the display facility is configured as a single piece with the unlatching element.

7. The short circuit indicator module of claim 6, wherein the display facility is configured monolithically with the unlatching element.

8. An electrical switching device for interrupting a current flow in the event of at least one of a short circuit and an overload in a subordinate power circuit, comprising:

at least two switching contacts, configured to control the current flow and isolatable in an event of at least one of the short circuit and overload;

a tripping device, including a trip element and an electromagnet, at least some of the current being able to flow through the electromagnet and magnetic forces of the electromagnet being usable to displace the trip element to a trip position in the event of a short circuit, trip position of the trip element being useable to actuate a switching mechanism of the electrical switching device to isolate the switching contacts; and the short circuit indicator module of claim 1.

9. The electrical switching device of claim 8, wherein the trip element includes a recess, configured to receive the unlatching element of the short circuit indicator module to establish a functional connection.

10. The electrical switching device of claim 8, wherein the electrical switching device is a circuit breaker.

11. The short circuit indicator module of claim 2, wherein the housing includes a first opening, disposed in such a manner that a test tool that is introducible through the first opening is engagable operationally with the unlatching element to test the short circuit indicator module.

12. The short circuit indicator module of claim 2, wherein the unlatching element is configured to block the electrical switching device by way of the functional connection.

13. The short circuit indicator module of claim 12, wherein the short circuit indicator module is embodied to be at least one of manually and automatically resettable to cancel the blocking of the electrical switching device.

14. The electrical switching device of claim 10, wherein the circuit breaker is a molded case circuit breaker.

15. The electrical switching device of claim 9, wherein the electrical switching device is a circuit breaker.

16. The electrical switching device of claim 15, wherein the circuit breaker is a molded case circuit breaker.

* * * * *